US010273757B2

(12) United States Patent
Savage et al.

(10) Patent No.: US 10,273,757 B2
(45) Date of Patent: Apr. 30, 2019

(54) DIRECTIONAL DRILLING APPARATUS WITH AN ALIGNED HOUSING BORE

(71) Applicant: Halliburton Energy Services, Inc., Houston, TX (US)

(72) Inventors: John Keith Savage, Edmonton (CA); Steven Graham Bell, Red Deer (CA)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 15/556,562

(22) PCT Filed: Apr. 16, 2015

(86) PCT No.: PCT/CA2015/000249

§ 371 (c)(1),
(2) Date: Sep. 7, 2017

(87) PCT Pub. No.: WO2016/165001

PCT Pub. Date: Oct. 20, 2016

(65) Prior Publication Data

US 2018/0051517 A1 Feb. 22, 2018

(51) Int. Cl.
*E21B 7/06* (2006.01)

(52) U.S. Cl.
CPC ..... *E21B 7/068* (2013.01); *E21B 7/062* (2013.01); *E21B 7/067* (2013.01)

(58) Field of Classification Search
CPC ..... E21B 7/067; E21B 7/068
See application file for complete search history.

(56) References Cited

U.S. PATENT DOCUMENTS 3,667,556 A * 6/1972 Henderson ..... E21B 4/02 175/107
4,694,914 A 9/1987 Obrecht
4,813,497 A 3/1989 Wenzel
(Continued)

FOREIGN PATENT DOCUMENTS

CA 2715867 A1 3/2012
GB 1494273 12/1977
WO 2014182303 A1 11/2014

OTHER PUBLICATIONS

Dusseault M., Alberta Department of Energy Publication entitled "CHOPS: Cold Heavy Oil Production with Sand in the Canadian Heavy Oil Industry", Chapter 6—Canadian CHOPS Production Practices, https://open.alberta.ca/publications/2815953; dated Mar. 2002 (28 pages).

*Primary Examiner* — Giovanna C Wright
(74) *Attorney, Agent, or Firm* — Terrence N. Kuharchuk; Parlee McLaws LLP; Craig W. Roddy

(57) ABSTRACT

A drilling apparatus including a tubular bearing housing, a tilted sleeve removably connected with the bearing housing, and a driveshaft. The bearing housing has a housing axis, a housing bore, and a housing bore axis. The housing bore axis is parallel with the housing axis. The tilted sleeve has a sleeve axis, a sleeve bore, and a sleeve bore axis. The tilted sleeve is connected with the bearing housing and is positioned within the housing bore. The sleeve axis is parallel with the housing bore axis and the sleeve bore axis is oblique to the sleeve axis. The driveshaft is rotatably supported within the sleeve bore. The driveshaft has a driveshaft axis. The driveshaft axis is parallel with the sleeve bore axis.

19 Claims, 5 Drawing Sheets

(56) References Cited

U.S. PATENT DOCUMENTS

| | | | | |
|---|---|---|---|---|
| 5,022,471 | A | 6/1991 | Maurer et al. | |
| 5,445,230 | A | 8/1995 | Wattenburg et al. | |
| 5,875,859 | A * | 3/1999 | Ikeda | E21B 4/003 175/256 |
| 6,196,336 | B1 | 3/2001 | Fincher et al. | |
| 6,543,554 | B2 | 4/2003 | Smith | |
| 6,554,083 | B1 | 4/2003 | Kerstetter | |
| 6,659,201 | B2 | 12/2003 | Head et al. | |
| 6,877,570 | B2 | 4/2005 | Chen et al. | |
| 7,823,660 | B2 | 11/2010 | Giroux et al. | |
| 8,141,658 | B2 | 3/2012 | Blair et al. | |
| 8,500,176 | B2 | 8/2013 | Marchand | |
| 8,689,905 | B2 | 4/2014 | Krueger et al. | |
| 8,721,182 | B2 | 5/2014 | Cioceanu | |
| 8,919,458 | B2 * | 12/2014 | Plop | E21B 7/067 175/61 |
| 2004/0211570 | A1 * | 10/2004 | Chen | E21B 7/067 166/382 |
| 2008/0197732 | A1 | 8/2008 | Cioceanu | |
| 2010/0011308 | A1 | 1/2010 | Shaw et al. | |
| 2012/0037428 | A1 | 2/2012 | Plop | |
| 2013/0168152 | A1 | 7/2013 | Panahi | |
| 2013/0213713 | A1 * | 8/2013 | Smith | E21B 7/067 175/45 |
| 2013/0319764 | A1 | 12/2013 | Schaaf et al. | |
| 2015/0308193 | A1 * | 10/2015 | Schurmann | E21B 7/062 175/61 |
| 2015/0368974 | A1 * | 12/2015 | Liu | E21B 7/067 175/104 |
| 2018/0163476 | A1 * | 6/2018 | Sadabadi | E21B 7/067 |

* cited by examiner

DIRECTIONAL DRILLING APPARATUS WITH AN ALIGNED HOUSING BORE

TECHNICAL FIELD

A drilling apparatus for use in directional drilling, having a tubular bearing housing with an aligned housing bore and a tilted driveshaft supported within the bearing housing.

BACKGROUND OF THE INVENTION

A borehole may be drilled using a drilling apparatus having a drill bit connected with a rotatable driveshaft. Directional drilling may be performed using a drilling apparatus in which the driveshaft axis (i.e., the axis of rotation of the driveshaft) is oblique to (i.e., angularly offset from) the longitudinal axis of the drilling apparatus, so that the driveshaft is tilted relative to the longitudinal axis of the drilling apparatus.

BRIEF DESCRIPTION OF DRAWINGS

Embodiments of the invention will now be described with reference to the accompanying drawings, in which.

DETAILED DESCRIPTION

Figure 1:
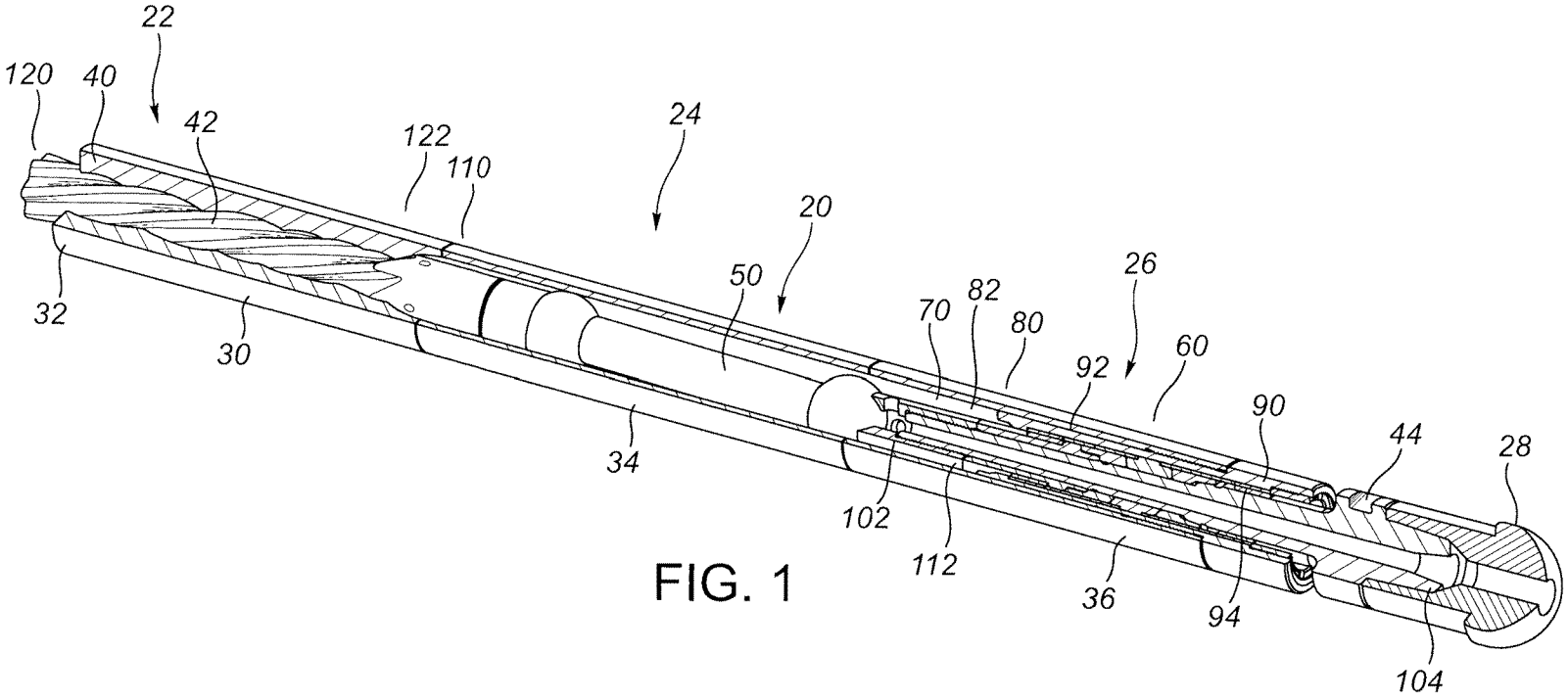
FIG. 1 is a partial longitudinal section, partial cutaway pictorial view of an embodiment of a drilling apparatus, including a tilted cartridge assembly connected with a tubular bearing housing.

References in this document to orientations, to operating parameters, to ranges, to lower limits of ranges, and to upper limits of ranges are not intended to provide strict boundaries for the scope of the invention, but should be construed to mean "approximately" or "about" or "substantially", within the scope of the teachings of this document, unless expressly stated otherwise.

References in this document to "proximal" means located relatively toward an intended "uphole" end, "upper" end and/or "surface" end of a borehole or of a pipe string positioned in a borehole.

References in this document to "distal" means located relatively away from an intended "uphole" end, "upper" end and/or "surface" end of a borehole or of a pipe string positioned in a borehole.

The present disclosure is directed at a drilling apparatus and at specific features of a drilling apparatus. The drilling apparatus may be configured to be inserted and/or contained and/or used within a borehole. In some embodiments, the drilling apparatus may be used for drilling a borehole.

The drilling apparatus may comprise any apparatus which is suitable for drilling. In some particular embodiments, the drilling apparatus may comprise, consist of, or consist essentially of a rotary steerable drilling apparatus for use in drilling a borehole. In some particular embodiments, the drilling apparatus may comprise, consist of, or consist essentially of a drilling motor for use in drilling a borehole.

In some embodiments, the drilling apparatus may comprise, consist of, or consist essentially of a positive displacement drilling motor. In some embodiments, the drilling apparatus may comprise, consist of, or consist essentially of a progressing cavity drilling motor, including but not limited to a Moineau-type progressing cavity motor.

The drilling apparatus comprises a tubular bearing housing and a driveshaft rotatably supported within the bearing housing. The axis of rotation of the driveshaft is oblique to (i.e., is angularly offset from) the longitudinal axis of the bearing housing, with the result that the driveshaft is tilted relative to the bearing housing. The tilting of the driveshaft relative to the bearing housing facilitates directional drilling using the drilling apparatus.

The tubular bearing housing may comprise a single housing component or may comprise a plurality of housing components. The driveshaft may comprise a single driveshaft component or may comprise a plurality of driveshaft components.

The tubular bearing housing has a housing exterior and defines a housing bore. The housing exterior defines a housing axis. The housing bore has a housing bore axis. The housing bore axis is parallel with the housing axis. The housing bore is therefore aligned with the housing exterior. As a result, the tilting of the driveshaft relative to the bearing housing is not achieved by or dependent upon the configuration of the bearing housing, and the bearing housing may therefore be considered to have an "aligned housing bore".

Although the bearing housing has an aligned housing bore, the housing exterior may be straight, bent or curved along all or a portion of its length. In some particular embodiments, the housing exterior may be substantially straight along its entire length The driveshaft has an axis of rotation which defines a driveshaft axis. The driveshaft axis is tilted relative to the housing axis so that the driveshaft is tilted relative to the bearing housing. The driveshaft may be tilted relative to the bearing housing in any suitable manner which enables the use of a bearing housing having an aligned housing bore. The driveshaft has a proximal end and a distal end.

In some embodiments, the tilting of the driveshaft may be achieved by mounting one or more tilting components within the housing bore which cause the driveshaft axis to tilt relative to the housing bore axis. A tilting component may comprise any suitable structure, device and/or apparatus or any suitable combination of suitable structures, device and/or apparatus.

In some particular embodiments, the one or more tilting components may comprise a tilted sleeve which is positioned within the housing bore. The tilted sleeve may comprise a single sleeve component or may comprise a plurality of sleeve components.

In some embodiments, the tilted sleeve may have a sleeve exterior and may define a sleeve bore. The sleeve exterior defines a sleeve axis. The sleeve bore has a sleeve bore axis. In some embodiments, the sleeve axis may be parallel with the housing bore axis. In some embodiments, the sleeve bore axis may be oblique to (i.e., angularly offset from) the sleeve axis so that the sleeve bore axis is oblique to both the housing bore axis and the housing axis.

In some embodiments, the tilted sleeve may be removably connected with the bearing housing. The tilted sleeve may be removably connected with the bearing housing in any suitable manner.

In some embodiments, as a non-limiting example, the tilted sleeve may be removably connected with the bearing housing with one or more threaded sleeve connections between the tilted sleeve and the bearing housing. In some embodiments, the housing bore may define an internal housing bore thread, the tilted sleeve may define an external sleeve thread, and a threaded sleeve connection may comprise the internal housing bore thread and the external sleeve thread.

In some embodiments, the driveshaft may be rotatably supported within the sleeve bore of the tilted sleeve so that the driveshaft axis is parallel with the sleeve bore axis and oblique to the sleeve axis. The driveshaft may be rotatably supported within the sleeve bore in any suitable manner.

In some embodiments, the drilling apparatus may comprise a bearing assembly interposed between the tilted sleeve and the driveshaft, for supporting the driveshaft within the sleeve bore. The bearing assembly may comprise any number and/or any types of bearings.

In some embodiments, the bearing assembly may comprise one or more thrust bearings for transmitting axial loads between the tilted sleeve and the driveshaft and/or one or more radial bearings for transmitting radial loads between the tilted sleeve and the driveshaft. The one or more thrust bearings and/or one or more radial bearings may comprise any suitable type or types of bearing, including as non-limiting examples, plain bearings and rolling element bearings.

In some embodiments, an annular space may be defined within the sleeve bore between the tilted sleeve and the driveshaft. In some such embodiments, the bearing assembly may comprise one or a plurality of internal bearings contained within the annular space so that the internal bearings are interposed radially between the tilted sleeve and the driveshaft. The internal bearing or internal bearings may comprise one or more internal thrust bearings and/or one or more internal radial bearings, which may comprise any suitable type or types of bearing, including as non-limiting examples, plain bearings and rolling element bearings.

In some embodiments, the components of the drilling apparatus may be assembled and/or disassembled separately. In some embodiments, the drilling apparatus may comprise a tilted cartridge assembly. In some such embodiments, the tilted cartridge assembly may be assembled into a unit and may be insertable within the housing bore while assembled and may be removable from the housing bore while assembled.

The tilted cartridge assembly may comprise any suitable components and/or any suitable combination of components of the drilling apparatus. In some embodiments, the tilted cartridge assembly may comprise the tilted sleeve and the driveshaft.

In some embodiments, the tilted cartridge assembly may further comprise a bearing assembly interposed between the tilted sleeve and the driveshaft, for supporting the driveshaft within the sleeve bore. The bearing assembly may comprise any number and/or any types of bearings.

In some embodiments, the bearing assembly may comprise one or more thrust bearings for transmitting axial loads between the tilted sleeve and the driveshaft and/or one or more radial bearings for transmitting radial loads between the tilted sleeve and the driveshaft. The one or more thrust bearings and/or one or more radial bearings may comprise any suitable type or types of bearing, including as non-limiting examples, plain bearings and rolling element bearings.

In some embodiments, an annular space may be defined within the sleeve bore between the tilted sleeve and the driveshaft. In some such embodiments, the bearing assembly may comprise one or a plurality of internal bearings contained within the annular space so that the internal bearings are interposed radially between the tilted sleeve and the driveshaft. The internal bearing or internal bearings may comprise one or more internal thrust bearings and/or one or more internal radial bearings, which may comprise any suitable type or types of bearing, including as non-limiting examples, plain bearings and rolling element bearings.

In some embodiments, the drilling apparatus may comprise a transmission shaft for transmitting rotation to the driveshaft. The transmission shaft may comprise any shaft or similar structure which is capable of facilitating the rotation of the driveshaft. The transmission shaft may comprise a single transmission shaft component or may comprise a plurality of transmission shaft components. In some embodiments, the transmission shaft may comprise a substantially stiff shaft and one or more articulating connections. In some embodiments, the transmission shaft may comprise a flex shaft. The transmission shaft has a proximal end and a distal end.

In some embodiments, the tilted cartridge assembly may further comprise the transmission shaft, which may be connected with the driveshaft. The transmission shaft may be connected with the driveshaft in any suitable manner, including as a non-limiting example, with a threaded connection. In some embodiments, the distal end of the transmission shaft may be connected directly or indirectly with the proximal end of the driveshaft. In some embodiments, one or more shafts, adapters and/or other structures may be interposed between the driveshaft and the transmission shaft so that the transmission shaft is connected indirectly with the driveshaft. In some embodiments, the transmission shaft may be connected directly with the driveshaft.

In some embodiments, the drilling apparatus may comprise a motor shaft for transmitting rotation to the driveshaft. The motor shaft may comprise a single shaft component or a plurality of shaft components. The motor shaft may comprise any shaft or similar structure which is capable of facilitating the rotation of the transmission shaft and/or of the driveshaft. In some embodiments, the motor shaft may comprise an output shaft from a motor. In some embodiments, the drilling apparatus may comprise a motor comprising a stator. In some such embodiments, the motor shaft may comprise a rotor which is configured to be received within the stator.

In some embodiments, the tilted cartridge assembly may further comprise the motor shaft, which may be connected with the transmission shaft. The motor shaft may be connected with the transmission shaft in any suitable manner, including as a non-limiting example, with a threaded connection. In some embodiments, the distal end of the motor shaft may be connected directly or indirectly with the proximal end of the transmission shaft. In some embodiments, one or more shafts, adapters and/or other structures may be interposed between the motor shaft and the transmission shaft so that the motor shaft is connected indirectly with the transmission shaft. In some embodiments, the motor shaft may be connected directly with the transmission shaft.

In some embodiments, the tilted cartridge assembly may comprise a drill bit, which may be connected with the driveshaft. The drill bit may be connected with the driveshaft in any suitable manner, including as a non-limiting example, with a threaded connection. The drill bit may comprise any structure, device or apparatus which is capable of performing a drilling or boring function including as non-limiting examples, a roller cone type drill bit or a fixed cutter type drill bit. The drill bit may be connected directly or indirectly with the distal end of the driveshaft. In some embodiments, one or more shafts, adapters and/or other structures may be interposed between the drill bit and the driveshaft so that the drill bit is connected indirectly with the driveshaft. In some embodiments, the drill bit may be connected directly with the driveshaft.

In some embodiments, the tilted cartridge assembly may be removably connected with the bearing housing. The tilted cartridge assembly may be removably connected with the bearing housing in any suitable manner.

In some embodiments, as a non-limiting example, the tilted cartridge assembly may be removably connected with the bearing housing with one or more threaded sleeve connections between the tilted sleeve and the bearing housing. In some embodiments, the housing bore may define an internal housing bore thread, the tilted sleeve may define an external sleeve thread, and a threaded sleeve connection may comprise the internal housing bore thread and the external sleeve thread.

In some embodiments, the drilling apparatus may comprise one or more retaining devices for retaining components of the drilling apparatus in an assembled configuration. In some particular embodiments, the drilling apparatus may comprise one or more retaining devices for retaining the internal bearings and/or other components within the annular space defined between the tilted sleeve and the shaft. Such retaining devices may comprise any suitable structures, devices and/or apparatus and/or suitable combinations of structures, devices and/or apparatus.

In some embodiments, the annular space may define a proximal end and a distal end. In some such embodiments, the drilling apparatus may comprise a proximal retainer device adjacent to the proximal end of the annular space. In some such embodiments, the drilling apparatus may comprise a distal retainer device adjacent to the distal end of the annular space.

In some embodiments, the proximal retainer device may comprise one or more retainer shoulders defined by the tilted sleeve within the sleeve bore and/or by the driveshaft, for preventing the internal bearings and/or other components from exiting the annular space from the proximal end of the annular space.

In some particular embodiments, the proximal retainer device may comprise a retainer shoulder defined by the tilted sleeve within the sleeve bore.

In some embodiments, the distal retainer device may comprise one or more retainer collars removably connected with the tilted sleeve and/or with the driveshaft, for preventing the internal bearings and/or other components from exiting the annular space from the distal end of the annular space.

The one or more retainer collars may be removably connected with the tilted sleeve and/or with the driveshaft in any suitable manner. In some embodiments, the retainer collars may be removably connected with the tilted sleeve and/or with the driveshaft with a threaded retainer connection.

In some particular embodiments, the distal retainer device comprises a retainer collar removably connected with the tilted sleeve. In such embodiments, the sleeve bore may define an internal retainer thread, the retainer collar may define an external retainer thread, and the threaded retainer connection may comprise the internal retainer thread and the external retainer thread.

In some embodiments, the drilling apparatus may comprise one or more external bearings, in addition to or in substitution for the internal bearings. In some particular embodiments, the drilling apparatus may comprise at least one external thrust bearing.

In some embodiments, the distal retainer device may comprise an external thrust bearing or a component of an external thrust bearing.

In some embodiments, the tilted sleeve may have a distal end and the driveshaft may define a bearing shoulder adjacent to the distal end of the tilted sleeve. In some such embodiments, an external thrust bearing may be positioned between the distal end of the tilted sleeve and the bearing shoulder of the driveshaft.

In some embodiments, the external thrust bearing may be removably connected with the tilted sleeve and/or with the driveshaft. The external thrust bearing may be removably connected with the tilted sleeve and/or with the driveshaft in any suitable manner.

In some embodiments, the external thrust bearing may comprise a sleeve bearing component connected with the tilted sleeve and a driveshaft bearing component connected with the driveshaft.

In some particular embodiments, the sleeve bearing component may be removably connected with the tilted sleeve with a threaded sleeve bearing connection between the sleeve bearing component and the tilted sleeve. In some particular embodiments, the sleeve bearing component may define an internal bearing thread, the tilted sleeve may define an external bearing thread, and the threaded sleeve bearing connection may comprise the internal bearing thread and the external bearing thread. In some particular embodiments, the distal retainer device may comprise the sleeve bearing component.

In some particular embodiments, the driveshaft bearing component may be removably connected with the driveshaft with a threaded driveshaft bearing connection between the driveshaft bearing component and the driveshaft. In some particular embodiments, the driveshaft bearing component may define an internal bearing thread, the driveshaft may define an external bearing thread, and the threaded driveshaft bearing connection may comprise the internal bearing thread and the external bearing thread.

FIGS. 1-7 depict non-limiting embodiments of a drilling apparatus suitable for use in directional drilling, wherein the drilling apparatus comprises a tubular bearing housing with an aligned housing bore and a tilted driveshaft supported within the bearing housing.

Figure 2:
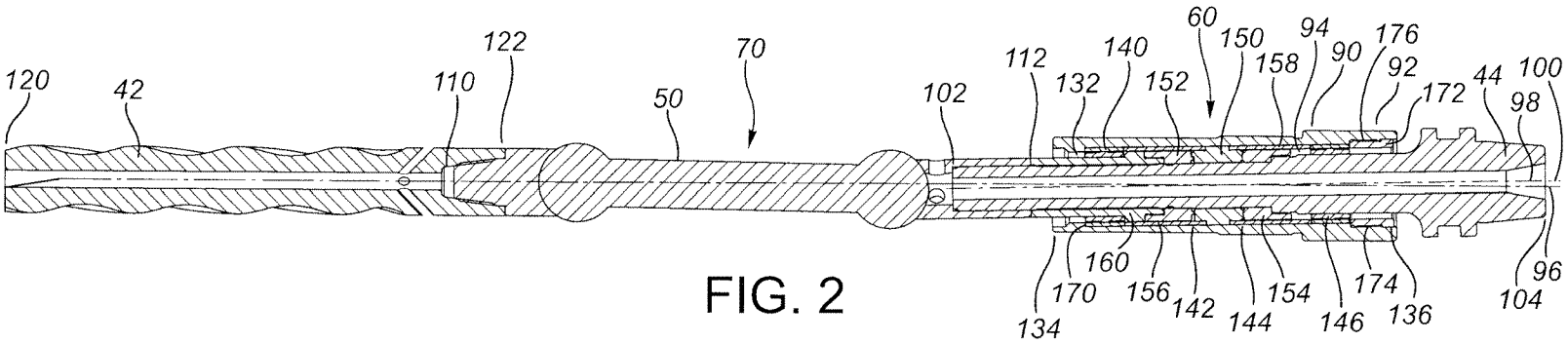
FIG. 2 is a longitudinal section assembly view of the tilted cartridge assembly in the drilling apparatus depicted in FIG. 1.
Figure 3:
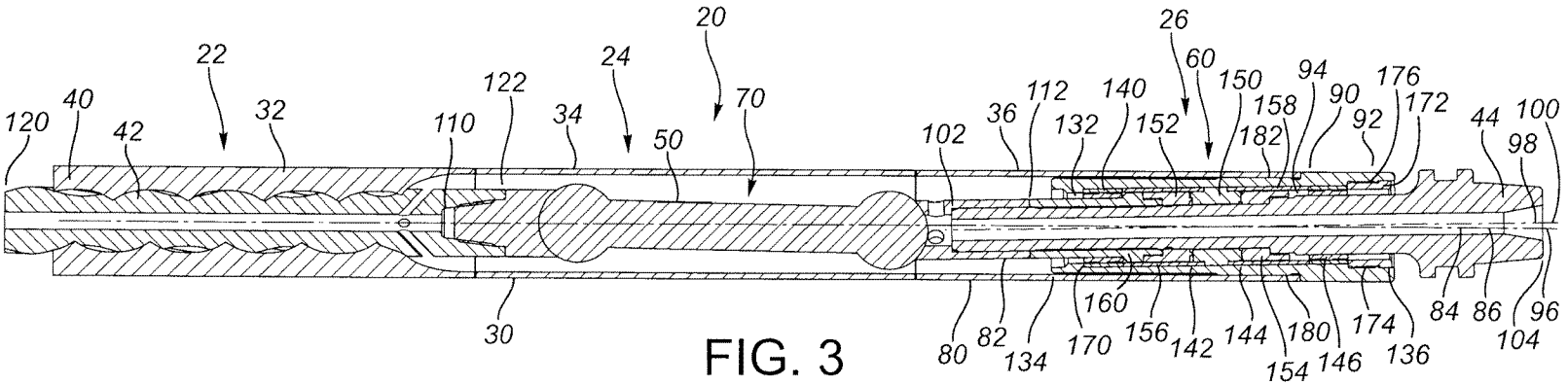
FIG. 3 is a longitudinal section assembly view of an embodiment of the drilling apparatus depicted in FIG. 1.
Figure 4:
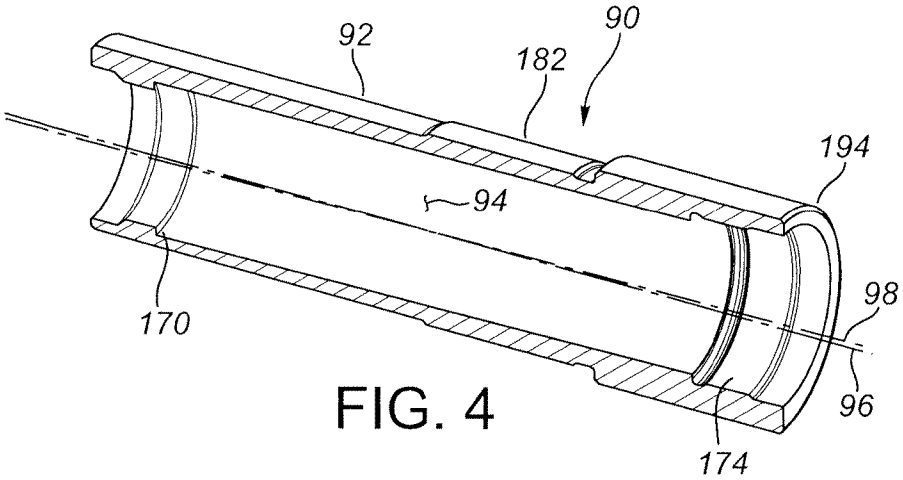
FIG. 4 is a longitudinal section pictorial view of the tilted sleeve in the drilling apparatus depicted in FIG. 1.
Figure 5:
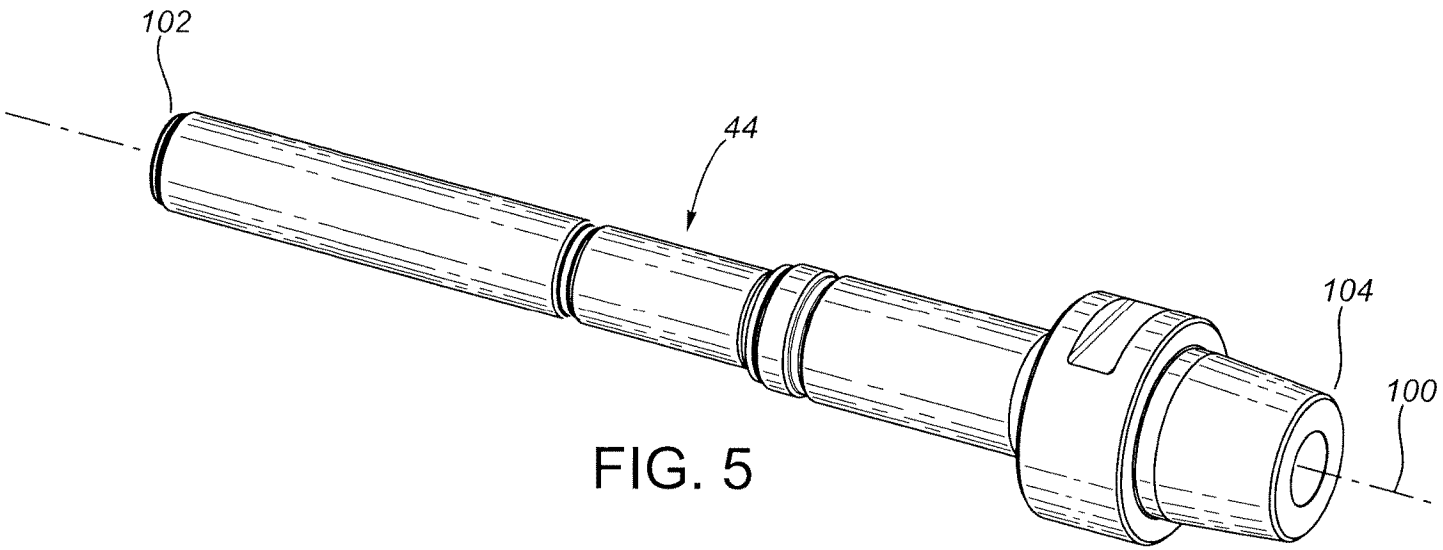
FIG. 5 is a pictorial view of the driveshaft in the drilling apparatus depicted in FIG. 1.
Figure 6:
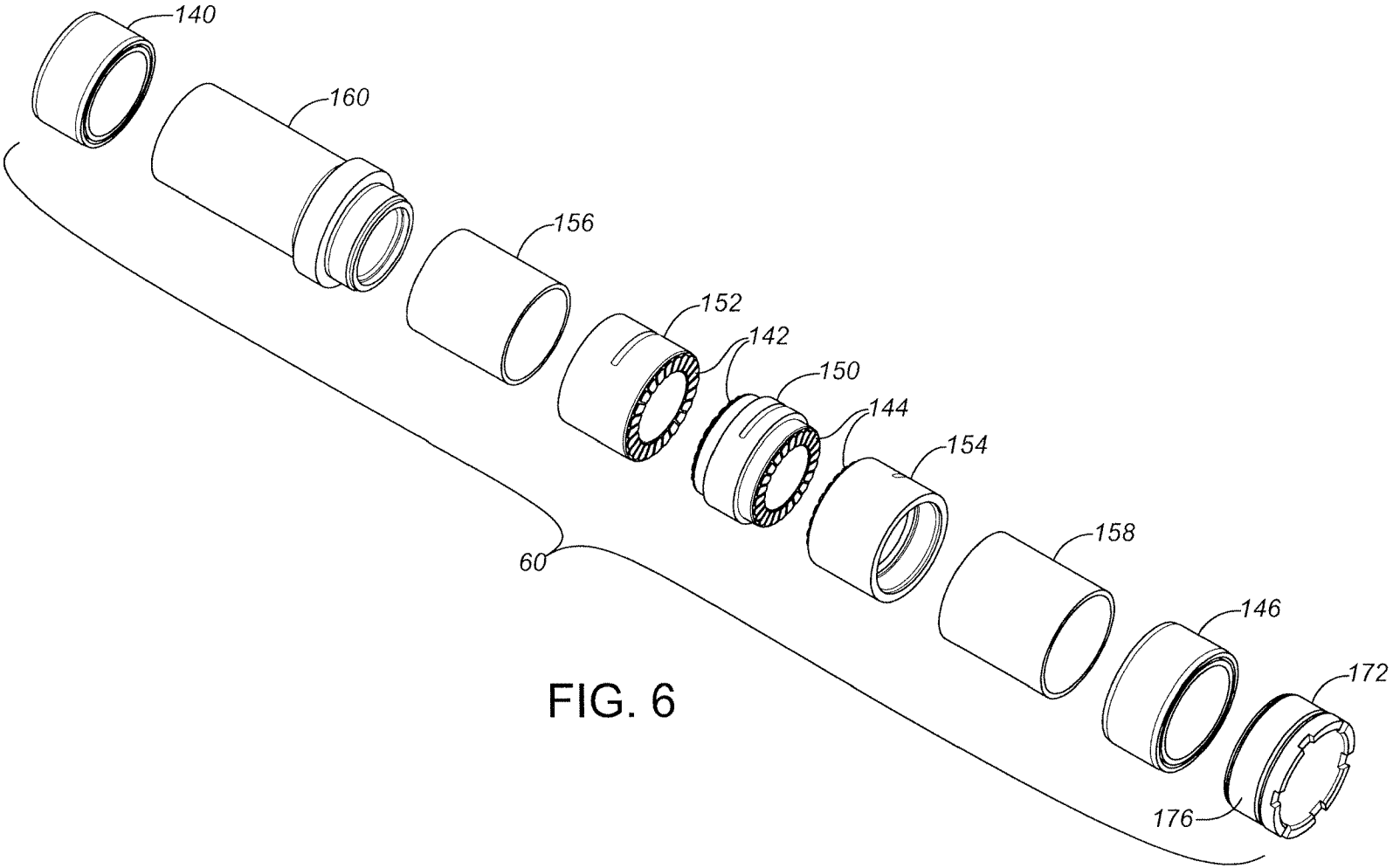
FIG. 6 is a pictorial view of selected components of the drilling apparatus depicted in FIG. 1.
Figure 7:
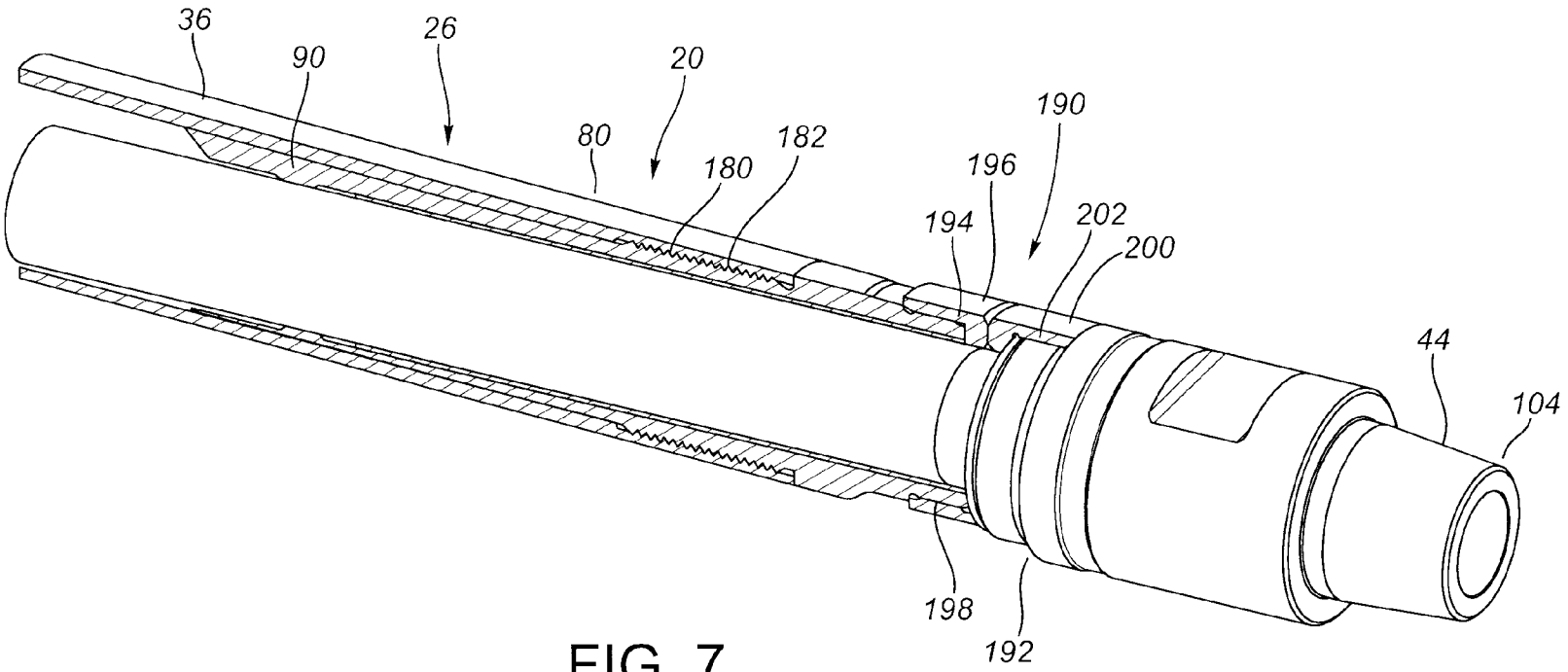
FIG. 7 is a longitudinal section pictorial view of a tilted sleeve and portions of a tubular bearing housing and a driveshaft in an embodiment of a drilling apparatus which includes an external thrust bearing.

More particularly, FIG. 1 pictorially depicts an embodiment of a drilling apparatus, including a tilted cartridge assembly connected with a tubular bearing housing. FIG. 2 depicts the tilted cartridge assembly in the drilling apparatus of FIG. 1. FIG. 3 is an alternate view of the drilling apparatus of FIG. 1. FIG. 4 depicts the tilted sleeve in the drilling apparatus of FIG. 1. FIG. 5 depicts the driveshaft in the drilling apparatus of FIG. 1. FIG. 6 depicts selected components of the drilling apparatus of FIG. 1. FIG. 7 depicts a tilted sleeve, portions of a tubular bearing housing, and portions of a driveshaft in an exemplary embodiment of the drilling apparatus which includes an external thrust bearing.

FIGS. 1-7 are exemplary only. The features of the drilling apparatus depicted in FIGS. 1-7 and described herein may be included in alternate designs and types of drilling apparatus.

Referring to FIGS. 1-7, the exemplary drilling apparatus (20) described herein comprise a drilling motor. The drilling motor comprises a plurality of sections, only some of which are depicted in FIGS. 1-7.

Referring to FIG. 1, depicted are a power section (22), a transmission section (24) and a bearing section (26). These sections of the drilling motor constitute components of a powertrain which utilizes fluid energy to rotate a drill bit (28).

The sections of the drilling motor are contained within a tubular housing (30). The housing (30) may comprise a single housing component or may comprise a plurality of housing components connected together in a suitable manner.

As depicted in FIG. 1, the housing (30) comprises a plurality of housing components connected together with threaded connections, including a tubular power housing (32) for the power section (22), a tubular transmission housing (34) for the transmission section (24), and a tubular bearing housing (36) for the bearing section (26).

The power section (22) of the drilling motor comprises a stator (40) and a rotor (42). The stator (40) is fixedly connected with the housing (30), and the rotor (42) is rotatable within the stator (40) in response to fluid circulating through the power section (22).

As depicted in FIG. 1, the power section (22) is a Moineau-type power section in which the stator (40) and the rotor (42) are lobed. The rotor (42) has one fewer lobe than the stator (40), and rotates within the stator (40) eccentrically relative to the axis of the drilling motor.

The transmission section (24) accommodates and converts the eccentric movement of the rotor (42) to concentric rotation of a driveshaft (44) within the bearing section (26).

As depicted in FIG. 1, the transmission section (24) comprises a transmission shaft (50) which is connected between the rotor (42) and the driveshaft (44) so that rotation of the rotor (42) causes rotation of the transmission shaft (50), and rotation of the transmission shaft (50) causes rotation of the driveshaft (44).

As depicted in FIG. 1, the bearing section (26) comprises portions of the driveshaft (44) and comprises a bearing assembly (60) which supports the driveshaft (44) within the housing (30) so that rotation of the transmission shaft (50) causes rotation of the driveshaft (44).

As depicted in FIG. 1, the drill bit (28) is connected with the driveshaft (44) so that rotation of the driveshaft (44) causes rotation of the drill bit (28).

Referring now to FIGS. 1-7, features of the drilling apparatus (20) are described in further detail, wherein FIGS. 1-6 depict an exemplary embodiment of the drilling apparatus (20) and FIG. 7 depicts a modified embodiment of the drilling apparatus (20) which includes an external thrust bearing.

Referring to FIG. 1 and FIG. 3, the exemplary embodiment of the drilling apparatus (20) comprises the housing (30) and a tilted cartridge assembly (70). In the exemplary embodiment, the tilted cartridge assembly (70) is configured to be insertable within the housing (30) while assembled and to be removable from the housing (30) while assembled. In the exemplary embodiment, the tilted cartridge assembly (70) is removably connected with the housing (30) to facilitate the assembly and disassembly of the drilling apparatus (20).

In the exemplary embodiment, the housing (30) comprises the power housing (32), the transmission housing (34), and the bearing housing (36).

The bearing housing (36) has a housing exterior (80) and defines a housing bore (82). The housing exterior (80) defines a housing axis (84). The housing bore (82) has a housing bore axis (86). The housing bore axis (86) is parallel with the housing axis (84) so that the housing bore (82) is aligned with the housing exterior (80), thereby providing an "aligned housing bore".

In the exemplary embodiment, the tilted cartridge assembly (70) comprises a tilted sleeve (90), the driveshaft (44), the transmission shaft (50) and the rotor (42). In some embodiments, the tilted cartridge assembly (70) may also comprise the drill bit (28). In other embodiments, the tilted cartridge assembly (70) may comprise fewer or more components of the drilling apparatus (20).

The tilted sleeve (90) has a sleeve exterior (92) and defines a sleeve bore (94). The sleeve exterior (92) defines a sleeve axis (96). The sleeve bore (94) has a sleeve bore axis (98). The sleeve bore axis (98) is oblique to (i.e., is angularly offset from) the sleeve axis (96), with the result that the tilted sleeve (90) has a varying wall thickness along its length and around its circumference.

The driveshaft has a driveshaft axis (100), a proximal end (102), and a distal end (104). The driveshaft (44) is rotatably supported within the sleeve bore (94) in a manner so that the driveshaft axis (100) is parallel with the sleeve bore axis (98), with the result that the driveshaft (44) is aligned with the sleeve bore (96).

The transmission shaft (50) has a proximal end (110) and a distal end (112). In the exemplary embodiment, the transmission shaft (50) comprises a relatively stiff shaft interposed between a pair of articulating connections. In the exemplary embodiment, the distal end (112) of the transmission shaft (50) is connected with the proximal end (102) of the driveshaft (44) with a threaded connection.

The rotor (42) has a proximal end (120) and a distal end (122). In the exemplary embodiment, the distal end (122) of the rotor (42) is connected with the proximal end (110) of the transmission shaft (50).

The drill bit (28) is connected with the distal end (104) of the driveshaft (44), typically with a threaded connection. The drill bit (28) may be a component of the tilted cartridge assembly (70), or the drill bit (28) may be connected with the driveshaft (44) after the drilling apparatus (20) is otherwise completely assembled.

In the exemplary embodiment, the tilted cartridge assembly (70) comprises a bearing assembly (60) interposed between the tilted sleeve (90) and the driveshaft (44), for supporting the driveshaft (44) within the sleeve bore (94).

In the exemplary embodiment, an annular space (132) is defined within the sleeve bore (94) between the tilted sleeve (90) and the driveshaft (44). The annular space (132) has a proximal end (134) and a distal end (136).

In the exemplary embodiment, the bearing assembly (60) comprises a plurality of internal bearings contained within the annular space (132). Specifically, in the exemplary embodiment, the bearing assembly (60) comprises, from the proximal end (134) to the distal end (136) of the annular space (132), an upper radial bearing (140), an off-bottom thrust bearing (142), an on-bottom thrust bearing (144), and a lower radial bearing (146).

The upper radial bearing (140) and the lower radial bearing (146) transmit radial loads between the tilted sleeve (90) and the driveshaft (44). The off-bottom thrust bearing (142) transmits tensile axial loads between the tilted sleeve (90) and the driveshaft (44). The on-bottom thrust bearing (144) transmits compressive axial loads between the tilted sleeve (90) and the driveshaft (44).

In the exemplary embodiment, the configuration of the tilted sleeve (90), the driveshaft (44) and the internal bearings (140, 142, 144, 146) within the tilted cartridge assembly (70) is achieved and maintained by a number of additional components and features of the tilted cartridge assembly (70). These components and features comprise a non-rotating assembly associated with the tilted sleeve (90) and rotating assembly associated with the driveshaft (44).

In the exemplary embodiment, the radial bearings (140, 146) each comprise a non-rotating race associated with the tilted sleeve (90) and a rotating race associated with the driveshaft (44).

In the exemplary embodiment, the thrust bearings (142, 144) each comprise a non-rotating thrust bearing component associated with the tilted sleeve (90) and a rotating thrust bearing component associated with the driveshaft (44). In the exemplary embodiment, a single non-rotating thrust bearing component (150) associated with the tilted sleeve (90) is interposed between a rotating off-bottom thrust bearing component (152) and a rotating on-bottom thrust bearing component (154) associated with the driveshaft (44).

Referring to FIGS. 2-6, in the exemplary embodiment, the non-rotating assembly comprises, from the proximal end (134) of the annular space (132) to the distal end (136) of the annular space (132), the non-rotating race of the upper radial bearing (140), an upper spacer (156), the non-rotating thrust bearing component (150), a lower spacer (158), and the non-rotating race of the lower radial bearing (146).

Referring to FIGS. 2-6, in the exemplary embodiment, the rotating assembly comprises, from the proximal end (134) of the annular space (132) to the distal end (136) of the annular space (132), the rotating race of the upper radial bearing (140), a bearing carrier (160), the rotating off-bottom thrust bearing component (152), the rotating on-bottom thrust bearing component (154), and the rotating race of the lower radial bearing (146). The components of the rotating assembly may be threadably connected with the driveshaft (44) or may be secured to the driveshaft (44) for rotation with the driveshaft (44) in some other manner.

Referring to FIG. 4, in the exemplary embodiment, a proximal retainer device is provided adjacent to the proximal end (134) of the annular space (132) for retaining the internal bearings (140, 142, 144, 146) within the annular space (132). In the exemplary embodiment, the proximal retainer device comprises a retainer shoulder (170) defined by the tilted sleeve (90) within the sleeve bore (94).

Referring to FIG. 3 and FIG. 6, in the exemplary embodiment, a distal retainer device is provided adjacent to the distal end (136) of the annular space (132) for retaining the internal bearings (140, 142, 144, 146) within the annular space (132). In the exemplary embodiment, the distal retainer device comprises a retainer collar (172) which is removably connected with the tilted sleeve (90) with a threaded retainer connection. More particularly, in the exemplary embodiment, the sleeve bore (94) defines an internal retainer thread (174), the retainer collar defines an external retainer thread (176), and the threaded retainer connection comprises the internal retainer thread (174) and the external retainer thread (176).

The components of the non-rotating assembly may be secured to the tilted sleeve (90) with threaded connections or in some other suitable manner. In the exemplary embodiment, the components of the non-rotating assembly are secured to the tilted sleeve (90) by being compressed between the retainer shoulder (170) and the retainer collar (172) by tightening of the retainer collar (172).

Referring to FIG. 1 and FIG. 3, the tilted cartridge assembly (70) may be assembled as a unit and may then be inserted within the housing (30) so that the rotor (42) is received within the stator (40), and may be connected with the housing (30) in order to complete the assembly of the drilling apparatus (20).

In the exemplary embodiment, the tilted cartridge assembly (70) is removably connected with the bearing housing (36) with a threaded sleeve connection between the tilted sleeve (90) and the bearing housing (36). More particularly, in the exemplary embodiment, the housing bore (82) defines an internal housing bore thread (180), the tilted sleeve (90) defines an external sleeve thread (182), and the threaded sleeve connection comprises the internal housing bore thread (180) and the external sleeve thread (182).

The drill bit (28) may be connected with the driveshaft (44) before the tilted cartridge assembly (70) is mounted within the housing (30) so that the drill bit (28) is a component of the tilted cartridge assembly (70), or the drill bit (28) may be connected with the driveshaft (44) at any other time before the drilling apparatus (20) is used for drilling.

Referring to FIG. 7, in a modified exemplary embodiment, the drilling apparatus may comprise an external thrust bearing (190) in addition to or in substitution for the internal bearings (142, 144). As depicted in FIG. 7, the driveshaft (44) may define a bearing shoulder (192) adjacent to a distal end (194) of the tilted sleeve (90), and the external thrust bearing (190) may be positioned between the distal end of the tilted sleeve (90) and the bearing shoulder (192) of the driveshaft (44).

As depicted in FIG. 7, the external thrust bearing (190) comprises a sleeve bearing component (196) which is removably connected with the tilted sleeve (90) with a threaded sleeve bearing connection (198) between the sleeve bearing component (196) and the tilted sleeve (90), and a driveshaft bearing component (200) which is removably connected with the driveshaft (44) with a threaded shaft bearing connection (202) between the driveshaft bearing component (200) and the driveshaft (44).

As depicted in FIG. 7, the sleeve bearing component (196) may be provided in addition to the retainer collar (172), or the sleeve bearing component (196) may function as and replace the retainer collar (172).

The exemplary tilted cartridge assembly (70) as depicted in FIGS. 1-7 may be assembled using the following exemplary steps, which may be performed in any suitable order:

1. if the drilling apparatus (20) comprises an external thrust bearing (190), the driveshaft bearing component (200) and the sleeve bearing component (196) may be passed over the proximal end (102) of the driveshaft (44) toward the distal end (104) of the driveshaft (44) until the driveshaft bearing component (200) engages the bearing shoulder (192) on the driveshaft (44);
2. the retainer collar (172) may be passed over the proximal end (102) of the driveshaft (44) toward the distal end (104) of the driveshaft (44) until it engages the bearing shoulder (192) on the driveshaft (44). In some embodiments, the sleeve bearing component (196) of the external thrust bearing (190) may supplement or replace the retainer collar (172). As a result, in some embodiments in which the drilling apparatus (20) comprises an external thrust bearing (190), the retainer collar (172) may be omitted;

3. the rotating on-bottom thrust bearing component (154) may be passed over the proximal end (102) of the driveshaft (44) toward the distal end (104) of the driveshaft (44) and may be threadably connected with the driveshaft (44);
4. the lower radial bearing (146) and the lower spacer (158) may be passed over the distal end (104) of the driveshaft (44) toward the proximal end (102) of the driveshaft, and the rotating race of the lower radial bearing (146) may be threadably connected with the driveshaft (44);
5. the non-rotating thrust bearing component (150) may be passed over the proximal end (102) of the driveshaft (44) toward the distal end (104) of the driveshaft (44) until it engages the rotating on-bottom thrust bearing component (154) and the lower spacer (158);
6. the rotating off-bottom thrust bearing component (152) may be threadably connected with the bearing carrier (160);
7. the bearing carrier (160) and the rotating off-bottom thrust bearing component (152) may be passed over the proximal end (102) of the driveshaft (44) toward the distal end (104) of the driveshaft until the rotating off-bottom thrust bearing component (152) engages the non-rotating thrust bearing component (150), and the bearing carrier (160) may be threadably connected with the driveshaft (44);
8. the upper spacer (156) and the upper radial bearing (140) may be passed over the proximal end (102) of the driveshaft (44) toward the distal end (104) of the driveshaft until the upper spacer (156) engages the non-rotating thrust bearing component (150), and the rotating race of the upper radial bearing (140) may be threadably connected with the bearing carrier (160);
9. the distal end (194) of the tilted sleeve (90) may be passed over the proximal end (102) of the driveshaft (44) until the retainer shoulder (170) on the tilted sleeve (90) engages the non-rotating race of the upper radial bearing (140);
10. if the drilling apparatus (20) comprises a retainer collar (172), the retainer collar (172) may be threadably connected with the distal end (194) of the tilted sleeve (90) with the threaded retainer connection and may be tightened to compress the non-rotating assembly between the retainer shoulder (170) and the retainer collar (172), thereby inhibiting rotation of the non-rotating assembly relative to the tilted sleeve (90);
11. if the drilling apparatus (20) comprises an external thrust bearing (190), the sleeve bearing component (196) and the driveshaft bearing component (200) may be threadably connected with the distal end (194) of the tilted sleeve (90) and with the driveshaft (44) respectively;
12. the proximal end (102) of the driveshaft (44) may be connected with the distal end (112) of the transmission shaft (50);
13. the proximal end (110) of the transmission shaft (50) may be connected with the distal end (122) of the rotor (42) in order to complete the assembly of the tilted cartridge assembly (70); or
14. optionally, the drill bit (28) may be connected with the distal end (104) of the driveshaft (44) in order to complete the assembly of the tilted cartridge assembly (70).

If the tilted cartridge assembly (70) comprises fewer or more components than those described above, the steps involved in assembling the tilted cartridge assembly (70) may be modified accordingly.

Once the tilted cartridge assembly (70) has been assembled as a unit, the assembly of the exemplary drilling apparatus (20) may be completed by inserting the tilted cartridge assembly (70) within the housing (30) so that the rotor (42) is received within the stator (40), and by threadably connecting the tilted sleeve (90) with the bearing housing (36) with the threaded sleeve connection. If the drill bit (28) has not previously been included in the assembly of the tilted cartridge assembly (70), the drill bit (28) may be connected with the distal end (104) of the driveshaft (44).

The exemplary drilling apparatus (20) as depicted in FIGS. 1-7 may be disassembled by reversing the steps described above in any suitable order.

ADDITIONAL DISCLOSURES

The following are non-limiting, specific embodiments of the drilling apparatus described herein:

Embodiment A. A drilling apparatus comprising:

(a) a tubular bearing housing having a housing exterior and defining a housing bore, wherein the housing exterior defines a housing axis, wherein the housing bore has a housing bore axis, and wherein the housing bore axis is parallel with the housing axis;

(b) a tilted sleeve removably connected with the bearing housing and positioned within the housing bore, wherein the tilted sleeve has a sleeve exterior and defines a sleeve bore, wherein the sleeve exterior defines a sleeve axis, wherein the sleeve bore has a sleeve bore axis, wherein the sleeve axis is parallel with the housing bore axis, and wherein the sleeve bore axis is oblique to the sleeve axis; and (c) a driveshaft rotatably supported within the sleeve bore, wherein the driveshaft has a driveshaft axis, and wherein the driveshaft axis is parallel with the sleeve bore axis.

Embodiment B. The drilling apparatus of Embodiment A, further comprising a bearing assembly interposed between the tilted sleeve and the driveshaft.

Embodiment C. The drilling apparatus of Embodiment B wherein an annular space is defined within the sleeve bore between the tilted sleeve and the driveshaft, wherein the bearing assembly comprises a plurality of internal bearings, and wherein the plurality of internal bearings is contained within the annular space.

Embodiment D. The drilling apparatus of Embodiment A wherein the drilling apparatus comprises a tilted cartridge assembly, wherein the tilted cartridge assembly is insertable within the housing bore while assembled, wherein the tilted cartridge assembly is removable from the housing bore while assembled, and wherein the tilted cartridge assembly comprises the tilted sleeve and the driveshaft.

Embodiment E. The drilling apparatus of Embodiment D wherein the tilted cartridge assembly further comprises a bearing assembly interposed between the tilted sleeve and the driveshaft.

Embodiment F. The drilling apparatus of Embodiment E wherein an annular space is defined within the sleeve bore between the tilted sleeve and the driveshaft, wherein the bearing assembly comprises a plurality of internal bearings, and wherein the plurality of internal bearings is contained within the annular space.

Embodiment G. The drilling apparatus of any one of Embodiments D through F wherein the tilted cartridge assembly is removably connected with the bearing housing with a threaded sleeve connection between the tilted sleeve and the bearing housing.

Embodiment H. The drilling apparatus of Embodiment G wherein the housing bore defines an internal housing bore thread, wherein the tilted sleeve defines an external sleeve thread, and wherein the threaded sleeve connection comprises the internal housing bore thread and the external sleeve thread.

Embodiment I. The drilling apparatus of Embodiment F wherein the bearing assembly comprises at least one internal thrust bearing for transmitting axial loads between the tilted sleeve and the driveshaft and at least one internal radial bearing for transmitting radial loads between the tilted sleeve and the driveshaft.

Embodiment J. The drilling apparatus of Embodiment I wherein the annular space has a proximal end and a distal end, further comprising a proximal retainer device adjacent to the proximal end of the annular space and a distal retainer device adjacent to the distal end of the annular space, for retaining the internal bearings within the annular space.

Embodiment K. The drilling apparatus of Embodiment J wherein the proximal retainer device comprises a retainer shoulder defined by the tilted sleeve within the sleeve bore.

Embodiment L. The drilling apparatus of any one of Embodiments J or K wherein the distal retainer device comprises a retainer collar removably connected with the tilted sleeve.

Embodiment M. The drilling apparatus of Embodiment L wherein the retainer collar is removably connected with the tilted sleeve with a threaded retainer connection, wherein the sleeve bore defines an internal retainer thread, wherein the retainer collar defines an external retainer thread, and wherein the threaded retainer connection comprises the internal retainer thread and the external retainer thread.

Embodiment N. The drilling apparatus of any one of Embodiments D through M wherein the driveshaft has a proximal end and wherein the tilted cartridge assembly comprises a transmission shaft connected with the proximal end of the driveshaft.

Embodiment O. The drilling apparatus of Embodiment N wherein the transmission shaft has a proximal end and wherein the tilted cartridge assembly comprises a motor shaft connected with the proximal end of the transmission shaft.

Embodiment P. The drilling apparatus of Embodiment O, further comprising a stator, wherein the motor shaft is a rotor, and wherein the rotor is received within the stator.

Embodiment Q. The drilling apparatus of any one of Embodiments A through P wherein the driveshaft has a distal end, further comprising a drill bit connected with the distal end of the driveshaft.

Embodiment R. The drilling apparatus of any one of Embodiments A through Q wherein the tilted sleeve has a distal end and wherein the driveshaft defines a bearing shoulder adjacent to the distal end of the tilted sleeve, further comprising an external thrust bearing positioned between the distal end of the tilted sleeve and the bearing shoulder of the driveshaft.

Embodiment S. The drilling apparatus of Embodiment R wherein the external thrust bearing comprises a sleeve bearing component and wherein the sleeve bearing component is removably connected with the tilted sleeve with a threaded sleeve bearing connection between the sleeve bearing component and the tilted sleeve.

Embodiment T. The drilling apparatus of Embodiment S wherein the external thrust bearing comprises a driveshaft bearing component and wherein the driveshaft bearing component is removably connected with the driveshaft with a threaded shaft bearing connection between the driveshaft bearing component and the driveshaft.

In this document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be one and only one of the elements.

We claim:

1. A drilling apparatus comprising:

(a) a tubular bearing housing having a housing exterior and defining a housing bore, wherein the housing exterior defines a housing axis, wherein the housing bore has a housing bore axis, and wherein the housing bore axis is parallel with the housing axis;

(b) a tilted sleeve removably connected with the bearing housing and positioned within the housing bore, wherein the tilted sleeve has a sleeve exterior and defines a sleeve bore, wherein the sleeve exterior defines a sleeve axis, wherein the sleeve bore has a sleeve bore axis, wherein the sleeve axis is parallel with the housing bore axis, and wherein the sleeve bore axis is oblique to the sleeve axis;

(c) a driveshaft rotatably supported within the sleeve bore, wherein the driveshaft has a driveshaft axis, and wherein the driveshaft axis is parallel with the sleeve bore axis; and (d) a tilted cartridge assembly, wherein the tilted cartridge assembly is insertable within the housing bore while the tilted cartridge assembly is assembled, wherein the tilted cartridge assembly is removable from the housing bore while the tilted cartridge assembly is assembled, and wherein the tilted cartridge assembly comprises the tilted sleeve and the driveshaft.

2. The drilling apparatus as claimed in claim 1, further comprising a bearing assembly interposed between the tilted sleeve and the driveshaft.

3. The drilling apparatus as claimed in claim 2 wherein an annular space is defined within the sleeve bore between the tilted sleeve and the driveshaft, wherein the bearing assembly comprises a plurality of internal bearings, and wherein the plurality of internal bearings is contained within the annular space.

4. The drilling apparatus as claimed in claim 1 wherein the tilted cartridge assembly further comprises a bearing assembly interposed between the tilted sleeve and the driveshaft.

5. The drilling apparatus as claimed in claim 4 wherein an annular space is defined within the sleeve bore between the tilted sleeve and the driveshaft, wherein the bearing assembly comprises a plurality of internal bearings, and wherein the plurality of internal bearings is contained within the annular space.

6. The drilling apparatus as claimed in claim 5 wherein the tilted cartridge assembly is removably connected with the bearing housing with a threaded sleeve connection between the tilted sleeve and the bearing housing.

7. The drilling apparatus as claimed in claim 6 wherein the housing bore defines an internal housing bore thread, wherein the tilted sleeve defines an external sleeve thread, and wherein the threaded sleeve connection comprises the internal housing bore thread and the external sleeve thread.

8. The drilling apparatus as claimed in claim 5 wherein the bearing assembly comprises at least one internal thrust bearing for transmitting axial loads between the tilted sleeve and the driveshaft and at least one internal radial bearing for transmitting radial loads between the tilted sleeve and the driveshaft.

9. The drilling apparatus as claimed in claim 8 wherein the annular space has a proximal end and a distal end, further comprising a proximal retainer device adjacent to the proximal end of the annular space and a distal retainer device adjacent to the distal end of the annular space, for retaining the internal bearings within the annular space.

10. The drilling apparatus as claimed in claim 9 wherein the proximal retainer device comprises a retainer shoulder defined by the tilted sleeve within the sleeve bore.

11. The drilling apparatus as claimed in claim 10 wherein the distal retainer device comprises a retainer collar removably connected with the tilted sleeve.

12. The drilling apparatus as claimed in claim 11 wherein the retainer collar is removably connected with the tilted sleeve with a threaded retainer connection, wherein the sleeve bore defines an internal retainer thread, wherein the retainer collar defines an external retainer thread, and wherein the threaded retainer connection comprises the internal retainer thread and the external retainer thread.

13. The drilling apparatus as claimed in claim 5 wherein the driveshaft has a proximal end and wherein the tilted cartridge assembly comprises a transmission shaft connected with the proximal end of the driveshaft.

14. The drilling apparatus as claimed in claim 13 wherein the transmission shaft has a proximal end and wherein the tilted cartridge assembly comprises a motor shaft connected with the proximal end of the transmission shaft.

15. The drilling apparatus as claimed in claim 14, further comprising a stator, wherein the motor shaft is a rotor, and wherein the rotor is received within the stator.

16. The drilling apparatus as claimed in claim 15 wherein the driveshaft has a distal end, further comprising a drill bit connected with the distal end of the driveshaft.

17. The drilling apparatus as claimed in claim 5 wherein the tilted sleeve has a distal end and wherein the driveshaft defines a bearing shoulder adjacent to the distal end of the tilted sleeve, further comprising an external thrust bearing positioned between the distal end of the tilted sleeve and the bearing shoulder of the driveshaft.

18. The drilling apparatus as claimed in claim 17 wherein the external thrust bearing comprises a sleeve bearing component and wherein the sleeve bearing component is removably connected with the tilted sleeve with a threaded sleeve bearing connection between the sleeve bearing component and the tilted sleeve.

19. The drilling apparatus as claimed in claim 18 wherein the external thrust bearing comprises a driveshaft bearing component and wherein the driveshaft bearing component is removably connected with the driveshaft with a threaded shaft bearing connection between the driveshaft bearing component and the driveshaft.

* * * * *